United States Patent [19]

Bateman

[11] Patent Number: 5,062,378

[45] Date of Patent: Nov. 5, 1991

[54] HYDROFOIL AND SURFBOARD TYPE ASSEMBLY

[76] Inventor: Jess R. Bateman, 2400 Palos Verdes Dr., West, #9, Palos Verdes Estates, Calif. 90274

[21] Appl. No.: 437,686

[22] Filed: Nov. 16, 1989

[51] Int. Cl.[5] ..... B63B 1/28

[52] U.S. Cl. ..... 114/274; 441/74

[58] Field of Search ..... 114/39.2, 274–282, 114/127, 129, 138, 139–143; 441/74, 79, 75, 65

[56] References Cited

U.S. PATENT DOCUMENTS

| | | | |
|---|---|---|---|
| 3,604,031 | 9/1974 | Cahill | 441/65 |
| 3,747,138 | 7/1973 | Morgan | 441/74 |
| 4,027,614 | 6/1977 | Jones | 114/126 |
| 4,040,373 | 8/1977 | Jones, Jr. | 114/163 |
| 4,508,046 | 4/1985 | Coulter et al. | 441/74 X |
| 4,610,634 | 9/1986 | Kimura | 441/75 |
| 4,715,304 | 12/1987 | Steinberg | 114/39.2 |
| 4,857,026 | 8/1989 | Hull | 114/274 X |

FOREIGN PATENT DOCUMENTS

| | | | |
|---|---|---|---|
| 2847277 | 5/1980 | Fed. Rep. of Germany | 441/74 |
| 2435267 | 5/1980 | France | 441/75 |
| 2545220 | 11/1984 | France | 114/39.2 |

*Primary Examiner*—Ed Swinehart

*Attorney, Agent, or Firm*—Poms, Smith, Lande & Rose

[57] ABSTRACT

A surfboard and hydrofoil assembly includes a surfboard having a generally elongated substantially flat board-like member with a density or specific gravity substantially less than that of water so that it will float. The surfboard has a top and a bottom surface and front and rear ends. At least one hydrofoil member is provided for supporting the main body of the surfboard out of the water when the assembly is moving forward at a relatively high speed. The hydrofoil member is removably secured to the bottom of said surfboard, and a tow rope or cable may be attached to the assembly. The surfboard assembly may be towed behind a motor boat or the like at high speeds, or may be used as a conventional surfboard, with said hydrofoil element being selectively removable.

13 Claims, 2 Drawing Sheets

FIG. 1
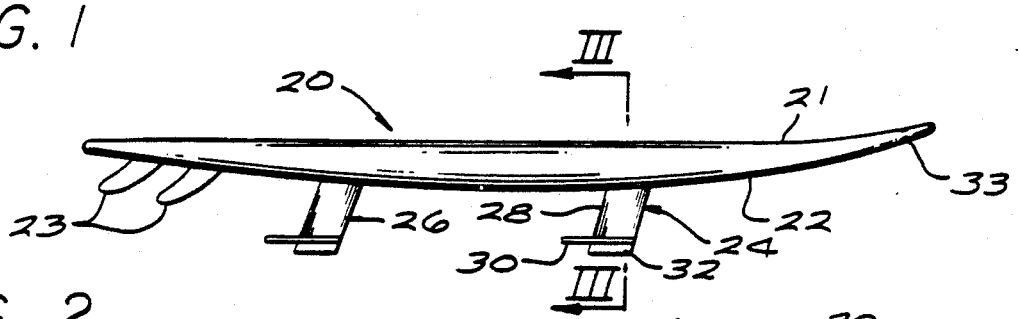
FIG. 2
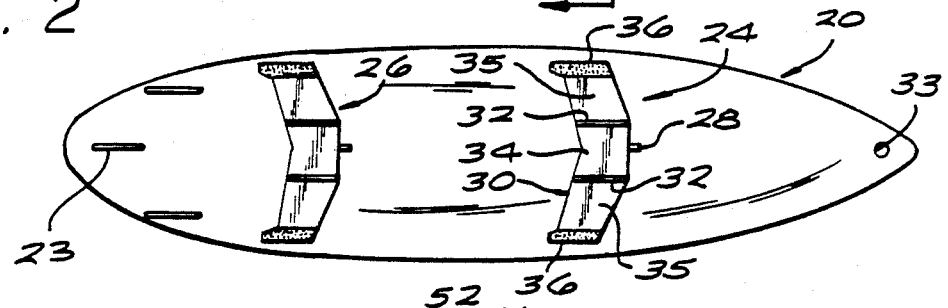
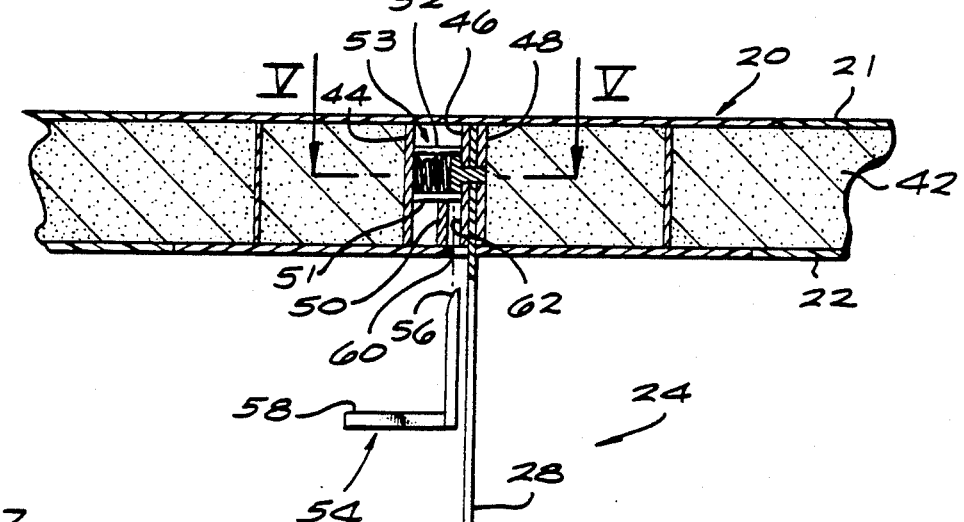
FIG. 3
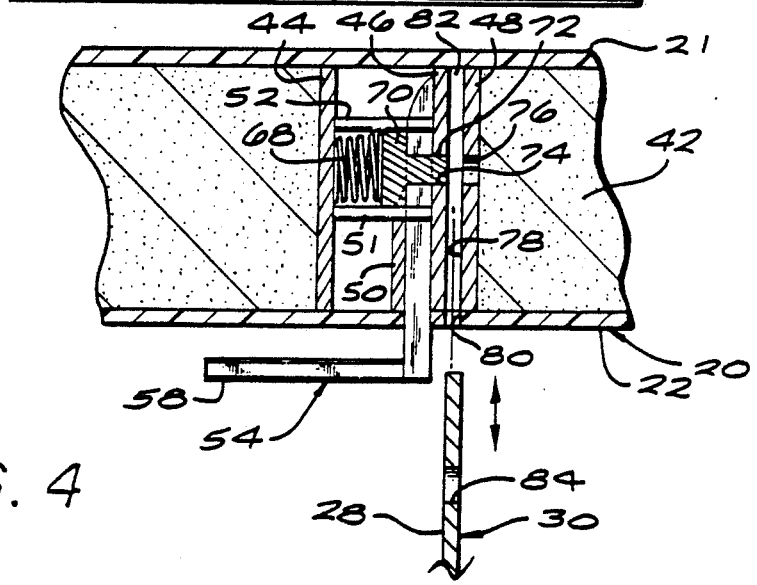
FIG. 4

FIG. 5
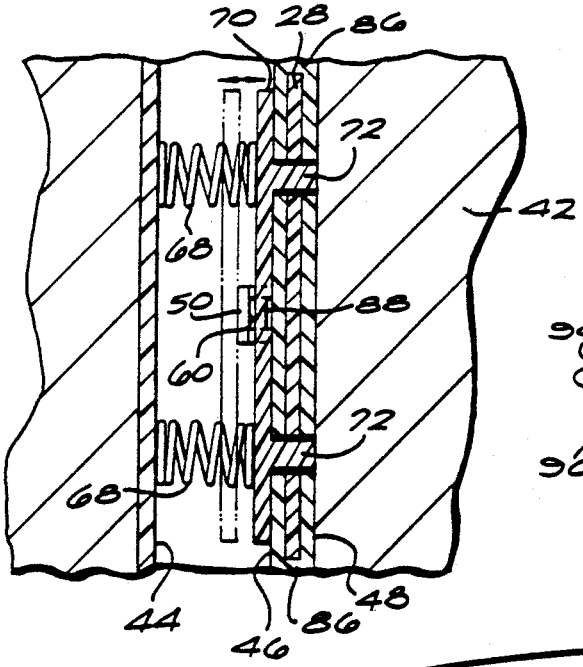
FIG. 6
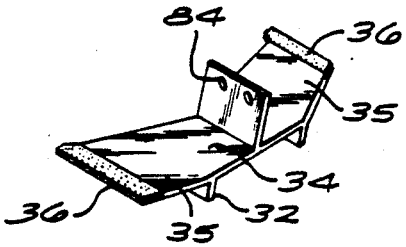
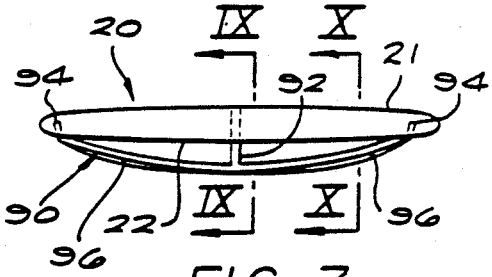
FIG. 7
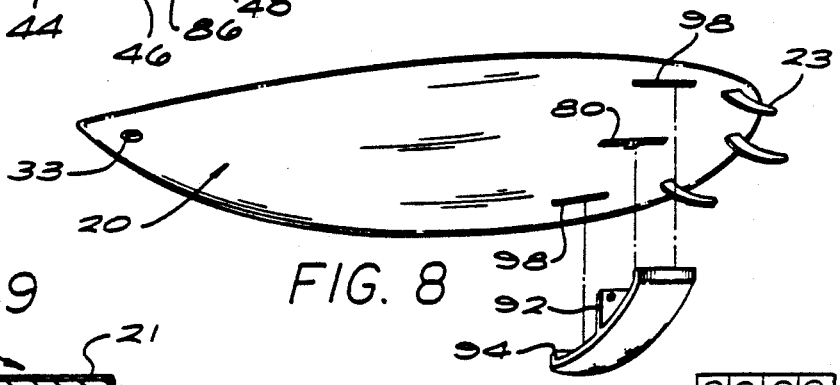
FIG. 8
FIG. 9
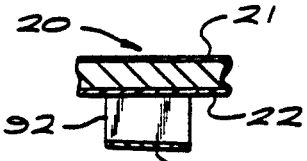
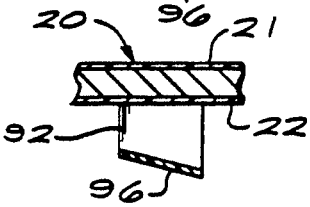
FIG. 10
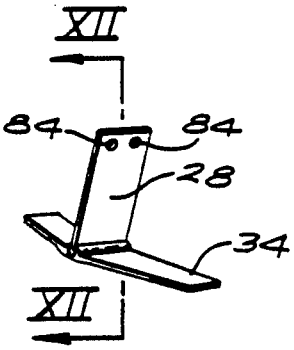
FIG. 11
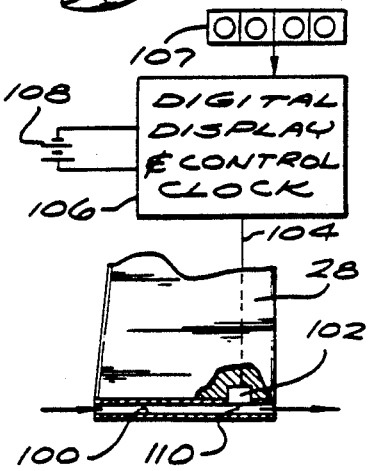
FIG. 12

HYDROFOIL AND SURFBOARD TYPE ASSEMBLY

FIELD OF THE INVENTION

This invention relates to hydrofoil assemblies with surfboards and related craft.

BACKGROUND

Various types of hydrofoils have been employed with powered ships. U.S. Pat. No. 4,027,614 (Jones) granted June 7, 1977, and U.S. Pat. No. 4,040,373 (Jones, Jr.) granted Aug. 9, 1977 show two such arrangements, in which the boats are powered by sails or engines.

U.S. Pat. No. 4,715,304 (Steinberg) granted Dec. 29, 1987 shows a hydrofoil arrangement on a windsurfer. Designed primarily to allow the user to change the angle of attack of its wings relative to the water, this arrangement employs a complicated pivoting mechanism.

In all of the above-mentioned prior devices, the hydrofoil arrangement is not intended or designed to be removed from the hull it is mounted on. Such permanent mounting limits the range of use of the associated water craft, since the craft are restricted to operation with a mounted hydrofoil. These prior-art arrangements are therefore not always suitable, and hydrofoils have consequently not been proposed for use with conventional surfboards. In surfboards, for example, the surfer may wish to be able to use the board not only for conventional wave surfing, but also for being towed behind a motorboat, and in such case the surfer should ideally be able to easily attach and remove hydrofoils from his board.

Accordingly, one important object of the present invention is to use hydrofoils with surfboards.

Another object of the invention is to allow easy mounting and detachment of the hydrofoils from surfboards.

SUMMARY OF THE INVENTION

In accordance with one aspect of the invention, a generally conventional surfboard is provided with one or more removable hydrofoils, so that the surfboard may be employed in a conventional manner without the hydrofoils or selectively with the hydrofoils.

The hydrofoil and surfboard assembly may, for example, include arrangements for towing the surfboard behind a high-speed motorboat. These arrangements may include an opening in the front of the surfboard or in the hydrofoil to which a rope or cable may be secured.

It is also noted that under certain favorable ocean surfing wave conditions, the surfboard may advantageously use the hydrofoil or hydrofoils and ride up on them without the surfboard being towed.

In accordance with another aspect of the invention, the hydrofoils may be firmly held in recesses in the lower surface of the surfboard by a locking or clamping mechanism, and may be selectively removed by releasing the locking or clamping mechanism and pulling the hydrofoils out of the recesses. The hydrofoil elements may have holes through their upper portions, or laterally protruding portions, for securing the hydrofoils in place by movable transverse members forming part of the locking or clamping mechanism.

In one embodiment of the invention, a hydrofoil may extend from one side of the surfboard to the other, and in another embodiment, a hydrofoil element may be supported only at the center, and extend laterally in both directions.

The hydrofoil element may be configured with a greater angle of attack at the sides thereof, to provide torque toward restoring the board toward a horizontal configuration when it is tilted.

DESCRIPTION OF THE DRAWINGS

FIG. 1 is a side view of a first embodiment of a surfboard and hydrofoil assembly according to the invention;

FIG. 2 is a bottom view of the surfboard and hydrofoil assembly according to the invention;

FIG. 3 is a cross-sectional view taken along the line III—III in FIG. 1, particularly showing a hydrofoil locking mechanism;

FIG. 4 shows on a greater scale a portion of FIG. 3;

FIG. 5 is a partially cross-sectional view taken along the line V—V in FIG. 1;

FIG. 6 is a perspective view of a foil according to the first embodiment of the invention;

FIG. 7 is a front view of a surfboard and hydrofoil assembly according to a second embodiment of the invention;

FIG. 8 is a perspective view of a surfboard and detached hydrofoil according to the second embodiment of the invention;

FIG. 9 is a cross-sectional view taken along the line IX—IX in FIG. 7;

FIG. 10 is a cross-sectional view taken along the line X—X in FIG. 7.

FIG. 11 is a perspective view of a foil provided with a device for determining speed; and FIG. 12 is a partially broken sectional view taken along line XII—XII in FIG. 11, as well as a simplified block diagram of a device for displaying surfboard speed.

DETAILED DESCRIPTION

As seen in FIG. 1, according to a first exemplary embodiment of this invention, a surfboard 20 has a top surface 21 and a bottom surface 22 and, in addition to conventional fins 23, is provided with a forward foil 24 and an aft foil 26. The number of foils need not be two, but may be varied according to the structural and operational requirements and goals of the particular surfboard chosen. In the illustrated embodiment, the aft foil is essentially identical to the forward foil. Consequently, only the forward foil 24 is described in detail below.

The foil 24 includes a strut 28, which is preferably angled somewhat aft, as is common for downward extending surfaces such as fins and keels on water craft, and as is understood in the field of hydrofoil design. A wing-like planing member 30 extends generally laterally on either side of the lower portion of the strut 28, and at least one foil fin 32 extends downward from the planing member 30 on either side of the strut 28.

It is assumed that the hydrofoil surfboard according to the invention will primarily be ridden while being towed behind a motorboat, so that most or all of the surfboard 20 will rise above the surface of the water. A towing point 33, such as a hole, a bracket, etc., is therefore provided at or near the forward tip of the surfboard 20. Where the towing point 33 consists of a hole, a tow line or cable may be easily rove through the hole and secured.

FIG. 2 is a bottom view of the surfboard and hydrofoil assembly, showing an advantageous shape for the foil 24. As seen in FIG. 2, the planing member 30 is mainly symmetrical with respect to the strut 28, and has an inner portion 34 and outer portions 35, which extend on either side of the inner portion. The inner portion 34 is preferably welded perpendicular to the strut 28. In the illustrated example, the leading edge of the inner portion 34 is mainly straight and perpendicular to the fore-and-aft line of the surfboard 20, whereas the leading edges of the outer portions, although straight, are slightly swept back. Having the leading edges straight makes it easier to manufacture the planing member, and provides fully satisfactory performance, but the planing member may also be made with a continuous, curved leading and/or trailing edge. The outer edges of the outer portions 35 of the planing member are preferably fitted with tip protectors 36 of, for example, plastic or a resilient material such as rubber, to lessen the risk of riders or others being cut or otherwise injured by the foil, and also to lessen or avoid damage to the foil upon collision or beaching.

FIG. 3 is an aft-facing cross-sectional view of the surfboard 20, the forward foil 24, and of a mechanism for attaching and removing the foil from the surfboard. The surfboard 20 itself will typically be made up of a highly buoyant core material 42 sandwiched between the hardened top and bottom surfaces 21 and 22, respectively, and will include various internal struts and other structural supports. A sandwich construction is, however, not necessary according to the invention. This invention does not relate to such general construction of surfboards, but rather to the use of hydrofoils together with the surfboard. General surfboard construction is well known in the art and is therefore not described further herein. The invention does, however, relate to a unique and advantageous arrangement for anchoring and locking the foils to the surfboard, and this arrangement will now be described in detail with reference primarily to FIGS. 3–5.

As seen in FIG. 3, a first vertical supporting wall 44, a second vertical supporting wall 46, and a third vertical supporting wall 48 extend in the direction of the fore-and-aft line of the surfboard. The top and bottom edges of the supporting walls 44, 46, and 48, conform to and are securely joined with the top and bottom surfaces, 21, 22 respectively, of the surfboard.

A fourth vertical supporting wall 50 conforms to and is securely joined with the bottom surface 22 of the surfboard 20, and extends upward, where it is joined approximately perpendicularly with a lower retaining wall 51. The lower retaining wall 51 is generally parallel with the top and bottom surfaces of the surfboard, and extends from the first vertical supporting wall 44 to the second vertical supporting wall 46. An upper retaining wall 52 also extends from the first vertical supporting wall 44 to the second vertical supporting wall 46. In the illustrated exemplary first embodiment, the retaining walls 51, 52 are parallel to each other and perpendicular to the four vertical supporting walls 44, 46, 48, and 50.

A foil locking assembly is designated generally with the reference numeral 53, and is described in greater detail below.

An advantageous foil insertion tool 54 has an insertion portion, preferably with a tapered, wedge-like tip 56, and a handle portion 58. The tool 54 is used to maneuver the foil locking assembly when attaching foils to the surfboard, or when removing them. In use, the tapered tip is inserted upward (viewed as in FIG. 3) through an opening 60 in the bottom surface 22 of the surfboard 20 and into a channel 62 between the second and fourth vertical supporting walls 46, 50.

FIG. 4 shows the foil locking assembly 53 in greater detail. Compression springs 68, such as the illustrated helical springs, are located between the upper and lower retaining walls 52, 51. An outer end of each spring 68 seats against the first vertical supporting wall 44, and an inner end of each spring seats against a locking plate 70, which has locking pins 72. The locking plate 70 and the locking pins 72 may either form a unitary member, or, alternatively, the pins may be separate elements which are securely fastened to the locking plate. The springs 68 bias the locking plate to lie against the second vertical supporting wall 46. The lower and upper retaining walls 51, 52 thereby form guides, so that the locking plate and the locking pins move mainly perpendicular to the second and third vertical supporting walls 46, 48 under the influence of the springs.

In a locking position (illustrated in FIG. 2), the locking plate bears against the second vertical supporting wall 46, and the locking pins 72 extend through holes 74, 76 (FIG. 4) in the second and third retaining walls 46, 48, respectively.

FIG. 4 shows the foil locking assembly 53 in a retracted position, in which the locking plate 70 is pushed away from the second vertical supporting wall 46 against the action of the springs 68. In the retracted position, the locking pins extend neither into the holes 76 in the third vertical supporting wall 48, nor into a foil slot or trunk 78, which is defined between the second and third supporting walls, is bounded upward by the top surface 21 of the surfboard 20, and opens through a transversely extending trunk opening 80 in the bottom surface of the surfboard.

In the locked position, the strut 28 of the foil is inserted through the trunk opening 80 and upward into the trunk 78 until strut holes 84 are aligned with the holes 74 and 76 in the second and third vertical supporting walls. In the locked position, the upper edge of the strut preferably rests either directly against the top surface 21 of the surfboard 20, or slightly compresses one or more optional leaf springs 82. The optional leaf springs may be provided at the uppermost end of the trunk 78 not only for protecting the top surface of the surfboard against bumps and abrasion from the strut, but also for biassing the foil downward and lessening the effect of any play in the trunk. Also in order to eliminate undesirable play and wobbling of the foil in the trunk, the width of the trunk 78 is approximately equal to the thickness of the strut 28, thus providing a snug fit. Furthermore, in the locked position, the foil is held in the trunk by the locking pins 72 sticking not only through the holes 74 and 76 in the second and third vertical supporting walls, but also through the strut holes 84.

FIG. 5 is a partially cross-sectional view from above of the surfboard and of the hydrofoil locking assembly. The up-and-down direction of FIG. 5 is the fore-and-aft direction of the surfboard. In the exemplary first embodiment of the invention shown in FIG. 5, two springs 68 and locking pins 72 are used. Although two pins are sufficient to firmly lock and stabilize the strut 28 in the trunk, more than two springs or locking pins may also be included.

As FIG. 5 shows, the second supporting wall 46 is preferably joined with the third supporting wall 48 by trunk side walls 86, which are preferably spaced apart at a distance approximately equal to the width of the strut 28. The trunk formed by the second and third supporting walls and by the trunk side walls, along with the top surface 21 (see FIG. 4) of the surfboard, therefore snugly and securely enclose the inboard portion of the strut. The trunk, consisting of the second and third supporting walls 46, 48, and the trunk side walls 86, may advantageously be made as a unit of metal or some other durable, rigid material.

The locking plate 70 has a vertical recess 88 facing the second vertical supporting wall 46. This recess 88 runs preferably the entire height of the locking plate, but may alternatively be made only in the lower portion of the plate. In order to insert or remove the strut 28, and thus the foil, the locking pins 72 may not extend into the trunk slot between the second and third vertical supporting walls 46, 48. To force the locking plate 70, and therefore the locking pins 72, to retract against the force of the springs 68, the tool 54 is first positioned as in FIG. 3 with the taper of the tapered tip 56 facing away from the strut 28. The tool is then inserted upward through the opening 60 so that the tapered tip 56 of the tool 54 enters the recess 88. As the tool is pushed further upward, the locking plate 70 is forced away from the strut 28 until the locking pins 72 are withdrawn from between the second and third vertical supporting walls 46, 48. In the locked position shown in FIG. 5, the ends of the locking pins are flush with the far surface (viewed as in FIG. 5, the right-most surface) of the trunk. In this case, the width of the vertical (viewed as in FIGS. 3 and 4), tapered portion of the tool 54 is therefore no less than the combined thicknesses of the strut 28 and the third vertical supporting wall 86, plus the depth of the recess 88.

When the tool is fully inserted as shown in FIG. 4, the locking plate is retracted to the position shown using broken lines in FIG. 5, and the locking pins do not extend into the trunk. The user may then freely mount the foil 24 by inserting the strut 28 into the trunk until the strut holes are aligned with the holes 74 and 76. Thereafter, the user pulls out the tool 54, so that the springs 68 will force the locking plate 70 toward the trunk, and thereby force the locking pins 72 through the holes 74, through the strut holes 84, and through the holes 76. If the foil was already mounted, when the tool 54 is inserted, the foil may easily be pulled out of trunk. In order to minimize any possible uneven action of the locking plate 70 when it moves, the springs 68 are preferably evenly spaced on either side of the opening 60.

FIG. 6 is a perspective view of the foil 24 according to the first embodiment of the invention. As FIG. 6 illustrates, the outer portions 35 of the planing surface 34 are preferably angled upward relative to the inner portion 34. This allows a foil surface to be mainly parallel to the water surface during planing maneuvers even when the surfboard is leaned into mild turns. The angle between the outer portions and the inner portion will be chosen with regard to the characteristics of the chosen surfboard. Furthermore, the outer portions 35, and possibly also the inner portion 34, may also be manufactured with a twist. In the illustrated embodiment, the foil fins 32 are welded along the approximate lines of intersection between the outer portions and the inner portion. The manufactured length of the foil fins 34 will be chosen with regard to the desired degree of lateral stability, longer fins providing greater resistance to lateral forces during planing and greater directional stability than shorter fins.

Although the hydrofoil surfboard according to the invention may be used for conventional wave-surfing, it is primarily intended to provide the user with the ability to ride the board while being towed behind a boat or other similar craft. Referring to FIG. 1, as mentioned above, a tow rope (not shown) is attached to the towing point 33 and the surfboard is trailed behind the tow boat. The rider then mounts the surfboard. At this point, the foils 24, 26, as well as the fins 23, will be completely below the surface of the water. As the boat accelerates, the board 20 will rise on the foils 24, 26 until the struts 28 of the foils are mostly above the water surface.

The speed with which the surfboard rises when towed, as well as the planing efficiency of the foils, depends, in addition to the towing force of the tow boat, on the angle of attack of the planing members 30 of the foils 24, 26. The angle of attack in turn depends primarily on 1) the length of the tow rope and the difference in height between the towing point 33 on the surfboard and the attachment point of the tow rope on the tow boat, i.e., the approximate angle the tow rope makes with the surface of the water; and 2) the angle the planing members 30 make with the general plane of the surfboard 20, i.e., approximately the angle between the planing members and the water surface when the surfboard floats at rest on the water.

Although FIG. 1 shows the planing members 30 having little or no inclination relative to the general plane of the surfboard, it is to be understood that they may also be inclined more. Furthermore, although the two foils 24, 26 in the first embodiment are structurally similar, the inclination of their planing members, as well as the length of their struts, need in no way be identical. If desired, as mentioned above, the planing members 30 (see FIG. 6) may also be manufactured with a twist, so that the angle of attack of the planing members varies over the length of the members, thus providing a restoring torque and increasing roll stability.

FIG. 7 is a front view of a hydrofoil surfboard according to a second embodiment of the invention. Reference numerals which indicate features identical to those used in the description of the first embodiment are retained in the following description. In the illustrated second embodiment a single foil 90 having a central strut 92 is mounted in the trunk of the surfboard 21 as was described above in connection with the description of the first embodiment, and in particular in connection with the discussion of FIGS. 3–5. Tips 94 of the foil 90 are mounted, however, in the bottom surface 22 of the surfboard rather than extending mainly perpendicular to the strut and parallel to the bottom surface as is the case in the first embodiment. The foil 90 thus generally has the shape of an arch extending laterally under the surfboard and anchored centrally in the trunk and at each tip.

Planing surfaces 96 of the foil 90 extend on either side of the strut 92 and end in the respective tip 94. As FIG. 7 shows, the planing surfaces have a gradually varying angle of attack from the strut out to the tips. In other words, between the strut 92 and the tips 94, the trailing edge of each planing surface 96 is angled downward.

FIG. 8 is a perspective view of the second embodiment of the invention showing more clearly the preferred mounting of the foil 90 on the surfboard 20. In particular, FIG. 8 shows that a fore-and-aft extending slot 98 is provided to receive each foil tip 94 as the strut 92 is inserted as described above into the foil trunk opening 80.

FIGS. 9 and 10 are cross-sectional views of the foil and surfboard taken respectively along the lines IX—IX and X—X in FIG. 7, whereby FIG. 9 shows a section which is inboard relative to the section shown in FIG. 10. Viewed together with FIG. 7, one sees that the angle to the bottom surface of the surfboard which the planing surfaces 96 make increases with distance from the strut 92, but return to approximately zero where the planing surfaces intersect the respective foil tip 94. The planing properties of the second embodiment, as well as its roll stability, will be altered by the predetermined deflection of the planing surfaces 96.

The second embodiment of the invention shown in FIGS. 7–10 is towed and will rise to ride on the surface of the water in the manner described above for the first embodiment.

FIGS. 11 and 12 illustrate an additional feature which may be incorporated into a foil used according to the invention. The main structural members of the illustrated foil are similar to those of the foil 24 of the first embodiment, so that corresponding reference numerals are retained A channel 100 extends lengthwise through the through the portion of the foil where the planing surfaces 34 intersect the strut 28. Alternatively, the channel 100 may be provided by securing a separate tubular member to the foil.

FIG. 12 is a partially cut-away sectional view of the foil provided with the channel 100, taken along the line XII—XII in FIG. 11. As is indicated by arrows, water flows through the channel 100 when the surfboard is in motion, i.e., when the surfboard is being towed. A transducer 102 is mounted in the strut 28, and is electrically connected by means of a lead 104 with a display device 106. A battery 108 provides electrical current to the display and, depending on the type of transducer, to the transducer as well.

The transducer 102 measures the rate of flow of water through the channel 100, which is approximately equal to the speed of the surfboard relative to the water. The transducer 102 may be of a known type, such as a paddle-wheel generator whose generated electrical current strength is proportional to the rate of flow of water across its blades; a differential pressure-measurement device; or an inductance transducer. In FIG. 12, an arm 110 extends into the channel 110 and is connected to a strain gauge (not shown). As the rate of flow of the water increases, the dynamically pressure-induced deflection of the arm is registered by the strain gauge. The deflection is thereby converted in a known manner into an electrical signal, which is conveyed via the lead 104 to the display 106.

The display 106 is suitably calibrated in units of speed and is mounted in or on the upper surface of the surfboard (see FIG. 1) so that the rider may see how fast he is going. The speed may either be displayed directly as digits, for example on an LCD-display which is sealed in a transparent, water-tight casing, or, for example, as a sequence of LEDs. The battery 108 may, but need not be, a conventional replaceable battery which fits in a suitable holder (not shown) in the surfboard. Alternatively, the battery may comprise one or more solar cells built into the upper surface of the surfboard and protected from damage by the rider and the water by being sealed with a clear, hard coating material. The digital display 106 may include a clock display, a maximum speed display, and an arbitrary display, under the control of suitable conventional input switches, as indicated at reference numeral 107.

The figures show two particularly advantageous embodiments of the invention. In connection with the description above of these embodiments, numerous alternatives have been mentioned. The following claims naturally encompass these alternatives. Regardless of the configuration of the planing surfaces of the chosen foil(s), the trunk and foil-locking arrangement shown in FIGS. 3–5 may be used to secure any foil which has a suitable strut provided with holes.

What is claimed is:

1. A surfboard and hydrofoil assembly comprising:

a surfboard including a generally elongated substantially flat board member having a density or specific gravity substantially less than that of water so that it will float, said surfboard having a top and a bottom surface and front and rear ends;

means including at least one hydrofoil member for supporting the main body of the surfboard out of the water when the assembly is moving forward at a relatively high speed; and foil securing means for removably securing said hydrofoil member to the bottom of said surfboard;

means for securing a rope or cable to said assembly;

locking means being provided for holding said hydrofoil member in the assembled configuration with said surfboard;

said hydrofoil member having a vertical strut;

said foil securing means including trunk means for receiving said hydrofoil member;

said trunk means including a foil slot opening through said bottom surface of the surfboard;

said locking means including retractable engaging means for engaging and locking said strut in said trunk means;

said strut including at least one strut hole; and said engaging means including for each said strut hole, a locking protrusion for extending through each said strut hole in a locking position, and spring means for biasing said engaging means into the locking position;

whereby said surfboard assembly may be towed behind a motor boat at high speeds, or may be used as a conventional surfboard, with said hydrofoil element being selectively removable.

2. A surfboard and hydrofoil assembly as defined in claim 1, wherein said engaging means includes a locking plate, whereby said locking protrusions consist of protruding portions of said locking plate.

3. A surfboard and hydrofoil assembly as defined in claim 2, wherein said engaging means includes a recess for receiving retraction means for compressing said spring means and for retracting said locking protrusions out of engagement with said strut.

4. A dual purpose surfboard and hydrofoil assembly comprising:

a surfboard including a generally elongated substantially flat board member having a density or specific gravity substantially less than that of water so that it will float; said surfboard having a top and a bottom surface and front and rear ends, said surfboard having a length which is more than twice the width thereof;

means including at least one hydrofoil member for supporting the main body of the surfboard out of the water when the assembly is moving forward at a relatively high speed;

means entirely within the surfboard for removably securing said hydrofoil member to the bottom of said surfboard and with the bottom of said surfboard being clear of all residual protruding hydrofoil associated structure when said foil is removed;

means for securing a rope or cable to the front of said surfboard; and said hydrofoil member having laterally extending portions bent back into engagement with said surfboard adjacent the sides of said surfboard;

whereby said surfboard assembly may be towed behind a motor boat at high speeds, or may be used as a conventional surfboard, with said hydrofoil element being selectively removable.

5. A surfboard assembly as defined in claim 4, further including a digital display on the front upper surface of said surfboard.

6. A dual purpose surfboard and hydrofoil assembly comprising:

a surfboard including a generally elongated substantially flat board member having a density or specific gravity substantially less than that of water so that it will float; said surfboard having a top and a bottom surface and front and rear ends, said surfboard having a length which is more than twice the width thereof;

means including at least two hydrofoil members for supporting the main body of the surfboard out of the water when the assembly is moving forward at a relatively high speed;

means entirely within the surfboard for removably securing said hydrofoil member to the bottom of said surfboard and with the bottom of said surfboard being clear of all residual protruding hydrofoil associated structure when said foil is removed;

means for securing a rope or cable to the front of said surfboard; and one of said two hydrofoil members being mounted toward the front and one being mounted toward the rear of said surfboard;

whereby said surfboard assembly may be towed behind a motorboat at high speeds, or may be used as a conventional surfboard, with said hydrofoil element being selectively removable.

7. A surfboard assembly as defined in claim 6 further including a digital display in the front upper surface of said surfboard.

8. A surfboard assembly as defined in claim 7 further including sensor means coupled to said display for indicating the speed of said surfboard.

9. A dual purpose surfboard and hydrofoil assembly comprising:

a surfboard including a generally elongated substantially flat board member having a density or specific gravity substantially less than that of water so that it will float; said surfboard having a top and a bottom surface and front and rear ends, said surfboard having a length which is more than twice the width thereof;

means including at least one hydrofoil member for supporting the main body of the surfboard out of the water when the assembly is moving forward at a relatively high speed;

means entirely within the surfboard for removably securing said hydrofoil member to the bottom of said surfboard and with the bottom of said surfboard being clear of all residual protruding hydrofoil associated structure when said foil is removed;

means for securing a rope or cable to the front of said surfboard;

locking means for holding said hydrofoil member in the assembled configuration with said surfboard;

said hydrofoil member having a vertical strut;

said hydrofoil securing means including trunk means for receiving said hydrofoil member;

said trunk means including a foil slot opening through said bottom surface of the surfboard; and said locking means including retractable engaging means for engaging and locking said strut in said trunk means;

whereby said surfboard assembly may be towed behind a motor boat at high speeds, or may be used as a conventional surfboard, with said hydrofoil element being selectively removable.

10. A surfboard assembly as defined in claim 9 further including a digital display on the front upper surface of said surfboard.

11. A dual purpose surfboard and hydrofoil assembly comprising:

a surfboard including a generally elongated substantially flat board member having a density or specific gravity substantially less than that of water so that it will float; said surfboard having a top and a bottom surface and front and rear ends;

means including at least two hydrofoil members for supporting the main body of the surfboard out of the water when the assembly is moving forward at a relatively high speed;

means within the surfboard for securing said hydrofoil member to the bottom of said surfboard and for clearing the bottom of said surfboard of all residual protruding hydrofoil associated structure when said foil is removed; and one of said two hydrofoil members being mounted toward the front and one being mounted toward the rear of said surfboard;

whereby said surfboard and hydrofoil assembly may be towed behind a motor boat at high speeds, or may be used as a conventional surfboard.

12. A surfboard assembly as defined in claim 11 further including a digital display on the front upper surface of said surfboard.

13. A surfboard assembly as defined in claim 11 further including a digital display on the front upper surface of said surfboard, and sensor means coupled to said display for indicating the speed of said surfboard.

* * * * *